United States Patent [19]

Luotolainen

[11] 3,942,346

[45] Mar. 9, 1976

[54] DISC CYLINDER LOCK

[75] Inventor: Reijo Luotolainen, Alahonkajoki, Finland

[73] Assignee: Oy Wartsila Ab, Helsinki, Finland

[22] Filed: Nov. 12, 1974

[21] Appl. No.: 523,061

[30] Foreign Application Priority Data

Nov. 16, 1973 Finland ..... 3548/73

[52] U.S. Cl. ..... 70/366; 70/377

[51] Int. Cl.[2] ..... E05B 29/02; E05B 15/14

[58] Field of Search ..... 70/366, 365, 377, 376

[56] References Cited

UNITED STATES PATENTS

| | | | |
|---|---|---|---|
| 730,831 | 6/1903 | Lock | 70/377 X |
| 3,771,340 | 11/1973 | Krakstrom | 70/338 |

FOREIGN PATENTS OR APPLICATIONS

| | | | |
|---|---|---|---|
| 25,706 | 12/1952 | Finland | 70/366 |

*Primary Examiner*—Robert L. Wolfe
*Attorney, Agent, or Firm*—Haseltine, Lake & Waters

[57] ABSTRACT

A disc cylinder lock comprising a number of turnable locking discs, which by turning of the key of the lock are turned from a certain initial position to a position releasing the lock mechanism. In the central part of some of the locking discs, there is an opening comprising two portions between which there are at least two substantially radial steps. One of the portions of the central opening receives the key of the lock while the other, when the key is properly inserted in the lock mechanism, forms at the side of the key a free space with a curved border, into which the key does not move in any of the functional phases of the lock. In front of the last mentioned locking discs, there is at least one other turnable element, for instance another type of locking disc, which has also, in its central part, an opening for the key. This opening is so formed that its border, at the point where its distance from the turning axis of the locking discs is the smallest, is located on the turning axis, in its immediate vicinity, or at the same side of the turning axis as the opposite border of the opening.

5 Claims, 3 Drawing Figures

DISC CYLINDER LOCK

Figure 1:
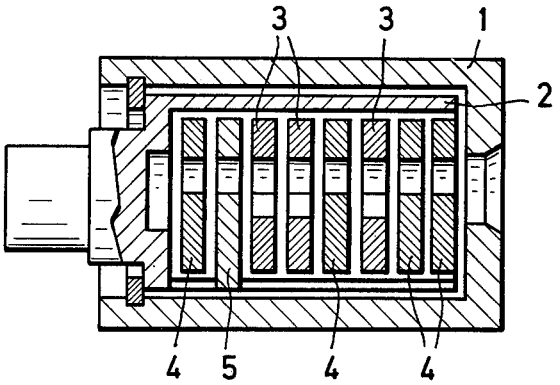

The invention relates to a disc cylinder lock comprising a number of turntable locking discs which by turning of the key of the lock are turned from a certain initial position to a position releasing the lock mechanism.

In the center of the locking discs of a disc cylinder lock, there is an opening for the key and this opening is usually semicircular. The linear side of the semicircle can, with respect to its function, be divided into two different parts. Of these one is located at the position of the combination surfaces of the key and works as a transmitting edge for the turning movement of the key when the key is turned into the position releasing the lock mechanism. The other part is located at the position of the return surface of the key and works as a movement transmitting edge when the key is turned back to its initial position. However, the linear part of the semicircular central opening has provided to form a good contact surface in case somebody wants to manipulate the lock with some other means than the key of the lock. Hence, the usual form of the central opening of the locking discs could contribute to make the use of picklocks and the development of different picking methods easier. Since the most important quality of a disc cylinder lock is its great security, especially with respect to picking, the pure chance of success in developing a picking method has to be considered a considerable drawback.

An object of the invention is to provide a disc cylinder lock, with a security against picking which has been developed considerably further than in known disc cylinder locks. The invention is characterized in that in the central part of some of the locking discs, there is an opening comprising two portions between which there are at least two substantially radial steps, one of which portions is arranged to receive the key of the lock and the other, when the key is properly inserted in the lock mechanism, forms at the side of the blade of the key does not move in any of the functional phases of the lock, additionally in the lock, in front of said locking discs, at least one turnable element is provided, for instance another type of locking disc, which has in its central part, an opening for the key, which opening is so formed that its border, at the point where its distance from the turning axis of the locking discs is the smallest, is located on the turning axis, in its immediate vicinity, or at the same side of the turning axis as the opposite border of the said opening.

In a lock according to the invention, special locking discs are combined with one or several turnable members of another type which, may also function as locking discs. This combination effectively prevents the application of known picking methods.

In a lock according to the invention, quite ordinary locking discs for disc cylinder locks can be advantageously used, that is, discs having a semicircular central opening for the key. This kind of locking disc completely fulfills the requirements stated in the claims for said other turnable element.

The expression "in the immediate vicinity of the turning axis," as used, means, in the context where it is used, a distance which is smaller than 1 mm.

The most simple embodiment of the special locking disc of a lock according to the invention is obtained, if the two portions of the central opening of the locking disc are given at least substantially the form of two semicircles of different size. The bigger semicircle can then be dimensioned to receive an ordinary key with semicircular cross-section. Thereby the advantage is obtained, that the lock does not require a special key, but quite ordinary semicircular cross-section keys for disc cylinder locks can be used.

The steps present in the central opening of a special locking disc of a lock according to the invention should be as small as possible. However, it is necessary that in spite of the rather large production tolerances of mass production, the combination surfaces and the return surface of the key, when the lock is old and worn, always are able to move the locking discs in a functionally correct way. Thorough tests have shown that the best result is obtained if the radial dimension of the steps is smaller than 2 mm and greater than 0.6 mm, preferably smaller than 1.5 mm and greater than 0.9 mm. The values are of course relevant for cylinder locks of dimensions which do not considerably deviate from the dimensions of ordinary cylinder locks. It can be considered a general dimension rule that the distance between the inner ends of the steps is about 60 % of the distance between the outer ends of the steps.

Figure 2:
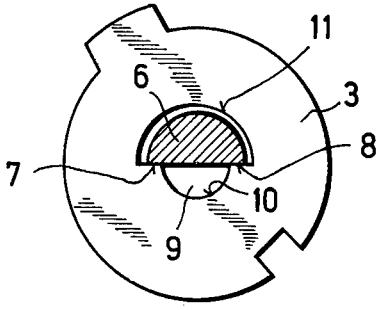
Figure 3:
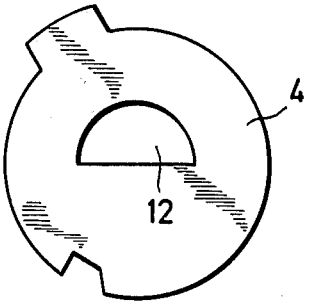

In the following, the invention will be more fully described with reference to the attached drawing in which FIG. 1 shows a lock according to the invention in axial section, FIG. 2 shows a special locking disc of a lock according to the invention; and FIG. 3 shows another type of locking disc for a lock according to the invention.

In the drawing, numeral 1 indicates the fixed outer cylinder of a cylinder lock, 2 a turnable inner cylinder inside the outer cylinder, 3 special locking discs of the lock, 4 normal locking discs of the lock and 5 a so called fixed locking disc. In the drawing, the lock according to the invention is shown only schematically, and hence, for instance, the generally used intermediate discs between the locking disc are not shown. In the drawing, only the parts essential for the understanding of the invention are shown.

From FIG. 2 the form of the central opening of a special locking disc 3 appears most clearly. Within the central opening is also shown the cross-section of key 6, which is semicircular. The turning of the key moves a locking disc 3 by means of the steps 7 and 8. Between these steps the central opening of the locking disc has been enlarged in a direction away from the space required by the key so that a free space 9 is formed, which is limited by a circular border 10. However, the border 10 does not need to be expressly circular, the main point is that it must be difficult to obtain force transmitting contact between the border and a turning tool, a picklock or the like. The same is true for the curved border 11 of the key receiving part of the central opening.

As evident from FIG. 2, the distance between the inner ends of the steps of the central opening of the locking disc 3 is about 60% of the distance between the outer ends of the steps. This means that if the last mentioned distance is 6 mm, which is a fairly suitable value in a small lock, the first mentioned distance is about 3.6 mm, so that the dimensions of the steps 7 and 8 would be only somewhat greater than 1 mm. The corners and angles present are in practice somewhat rounded off so that the linear part of the steps 7 and 8 may be smaller than 1 mm.

The central opening 12 of the normal locking disc 4 shown in FIG. 3 is semicircular, that is, has the same form as the upper part of the central opening of the special locking disc shown in FIG. 2. The linear border part of the central opening of a locking disc according to FIG. 3 passes through the turning axis of the locking disc.

The invention is not limited to the embodiment shown, but covers modifications within the scope of the following claims.

I claim:

1. A disc cylinder lock comprising a number of turnable locking discs, which by turning of the key of the lock are turned from an initial position to a position releasing the lock mechanism, there being, in the central part of some of the locking discs, an opening having portions between which there are at least two substantially radial steps one, of which portions is arranged to receive the key of the lock and the other, when the key is properly inserted in the lock, forming, at the side of the inserted part of said key, a free space with a curved border, into which said key does not move in any of the functional phases of the lock, there being further, in the lock in front of said last mentioned locking discs, at least one turnable element having in its central part an opening for said key, which opening is so formed that its border, at the point where its distance from the turning axis of said locking discs is the smallest, is located within an area including said turning axis, the space between said turning axis and the opposite border of said opening and an area in the immediate vicinity of said turning axis remote from said opposite border of said opening.

2. A lock according to claim 1, in which both said portions of the central opening of said first mentioned locking disc are at least substantially formed as semicircles of different size arranged along a common diameter.

3. A lock according to claim 1, in which the radial extension of said steps is between 0.6 mm and 2 mm.

4. A lock according to claim 3 in which the radial extension of said steps is between 0.9 and 1.5 mm.

5. A lock according to claim 1, in which the distance between the radially inner ends of said steps is about 60% of the distance between the radially outer ends of said steps.

* * * * *